United States Patent [19]

Therkorn

[11] Patent Number: 4,638,793

[45] Date of Patent: Jan. 27, 1987

[54] COUCH OF ADJUSTABLE INCLINATION FOR BODY EXTENSION

[76] Inventor: Jens Therkorn, Volpinistrassee 2, 8000 Munich 19, Fed. Rep. of Germany

[21] Appl. No.: 709,025

[22] PCT Filed: Jun. 22, 1984

[86] PCT No.: PCT/EP84/00186

§ 371 Date: Feb. 26, 1985

§ 102(e) Date: Feb. 26, 1985

[87] PCT Pub. No.: WO85/00104

PCT Pub. Date: Jan. 17, 1985

[30] Foreign Application Priority Data

Jun. 28, 1983 [DE] Fed. Rep. of Germany ..... 3323310

[51] Int. Cl.[4] ..... A61H 1/02

[52] U.S. Cl. ..... 128/71

[58] Field of Search ..... 128/70–75

[56] References Cited

U.S. PATENT DOCUMENTS

| | | | |
|---|---|---|---|
| 238,799 | 3/1881 | Morgan | 128/72 |
| 1,018,757 | 2/1912 | Grady | 128/70 |
| 2,598,204 | 5/1952 | Allen | 128/74 |
| 2,695,017 | 11/1954 | Herrmeyer | 128/71 |
| 2,768,622 | 10/1956 | Sanders | 128/71 |
| 3,238,936 | 3/1966 | Siedentop | 128/71 |
| 3,286,708 | 11/1966 | Gartner | 128/70 |
| 3,388,700 | 6/1968 | Mountz | 128/71 |
| 3,527,202 | 9/1970 | Donzelle | 128/71 |
| 3,759,252 | 9/1973 | Berman | 128/70 |
| 3,821,953 | 7/1974 | Mikan | 128/71 |
| 3,835,844 | 9/1974 | Lang | 128/71 |
| 4,378,791 | 4/1983 | Sarrell | 128/71 |

*Primary Examiner*—Clifford D. Crowder

*Attorney, Agent, or Firm*—Toren, McGeady Goldberg

[57] ABSTRACT

In a couch 10 of adjustable inclination for body extension in a head-down position with a couch carrier 12 and a support table 14 securable on the carrier 12 in different inclinations and provided with a foot and/or calf retaining device 96; 102, it is proposed that the body support length a+b+c between the retaining device 96 and the head rest 128 is adjustable continuously or in fine stages according to the increasing body extension, with the inclined table 14 occupied in a head-down position. Thus it is possible to achieve a protective traction treatment.

27 Claims, 8 Drawing Figures

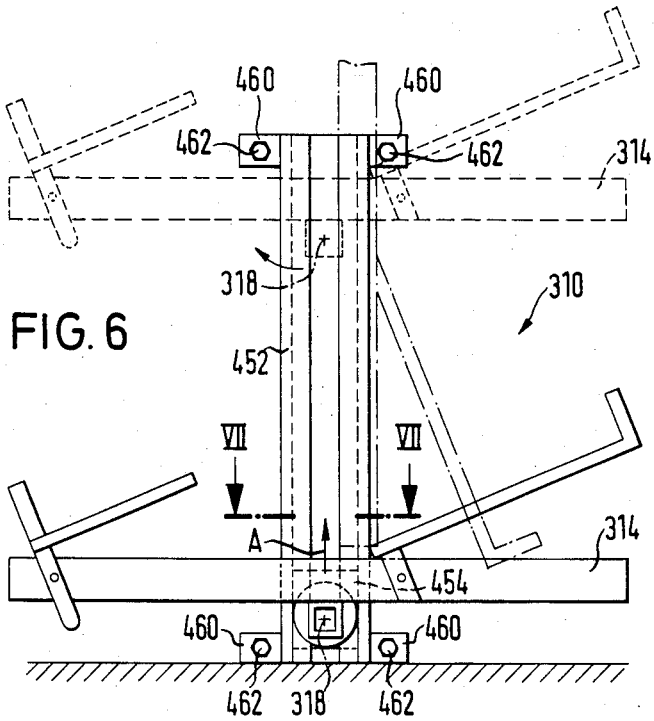
FIG. 6
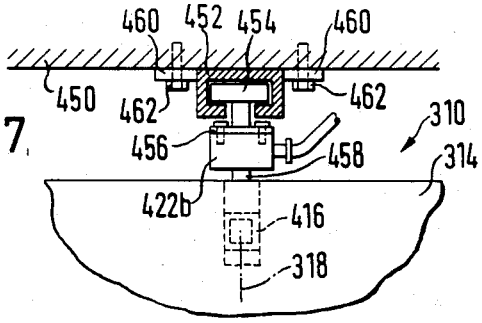
FIG. 7
FIG. 8
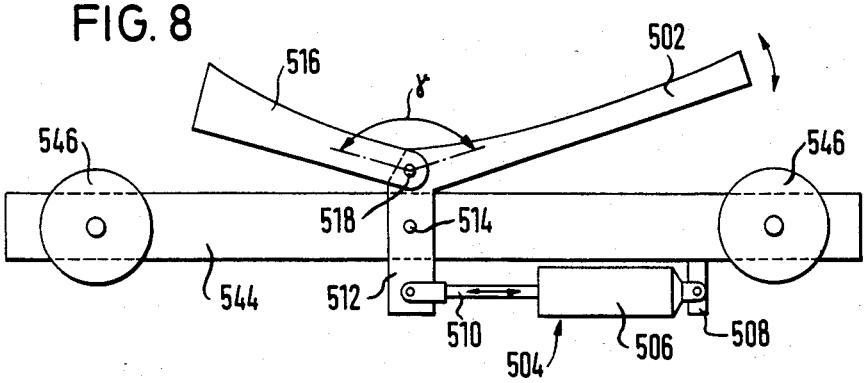

COUCH OF ADJUSTABLE INCLINATION FOR BODY EXTENSION

The invention relates to a couch of adjustable inclination, especially for body extension in a head-down position, having a couch carrier and a support table securable to the carrier in different inclinations and provided with a foot or lower-leg retaining device and a head rest.

The stretching of body joints, especially of the spinal column, is an important therapeutic measure in connection with the therapy of rheumatic ailments, muscular strains, posture damage or the like. In healthy persons body stretching can contribute to an increase of well-being, especially to the promotion of relaxation. Horizontal stretching tables are known on which the body is stretched by the drawing slightly apart of a foot loop and a head loop by means of an appropriate mechanism. It is disadvantageous here that the body is subject to the applied traction force over its entire length between the fastening points, so that by way of example the cervical vertebrae are subject to the same traction stress as the two knee joints together. However it is frequently desired to load a part of the joints, at least at the beginning of therapy, to a reduced extent or not at all. This is valid especially in the case of muscle strains and spinal column torsions. Too great an extension of the joints associated with the muscular strain, especially the corresponding vertebrae, would lead to a reflextype increase of the muscular strain.

With the couches of adjustable inclination of the kind as initially mentioned, the traction force in the head-down position naturally decreases from the feet to the head, since the remaining body length to be carried by the joint concerned decreases towards the head. In order, especially in the case of neck nape stresses, to relieve the vertebrae in the neck region at least initially, a head rest is provided on which the head is supported. While in the known couches of adjustable inclination the head rest can be made fast to the support table in different positions, for adjustment to different body sizes, there is however no possibility of altering the head rest position or the retaining device position during the traction treatment, that is with the couch occupied in the headdown position. However the joint and muscle extensions occurring as desired during the traction treatment result in an increase of the body size by up to 1–2 cm. With an unchanged body support length between retaining device and head-rest this leads to an "upsetting" of the body in the neck nape region, that is to a complete elimination of the desired tensions present here and to the build-up of compression stresses, with corresponding deviation of the spinal column by slight S-shaped curvature.

The problem of the invention consists in preparing a couch of adjustable inclination for body extension which permits the setting and maintenance of a desired extension condition during the traction treatment, independently of the body elongation.

This problem is solved in that the body support length between the retaining device and the head-rest is adjustable continuously or by fine stages according to the increasing body extension, with the table occupied in the head-down position With increasing body elongation the body support length is correspondingly adjusted, so that constant tension conditions result.

On the known horizontal traction table and the known couch of adjustable inclination the couch support surface, apart from cushioning, is substantially flat. In the case of muscle strains, spinal column torsions, rheumatic ailments or the like the body assumes what is called a protective posture in which pains are least perceived. Frequently the protective posture consists in an angling off of the knee joints and of the thich-pelvis joints. Such bending also corresponds to a relaxation position in the healthy person (posture of the unborn child in the womb). If in traction treatment one starts from such a protective or relaxation position, the danger of the occurrence of additional strains or even injuries (joint injuries, muscle micro-tearing or the like) is practically eliminated. A bent-knee support according to a further development of the invention now renders possible the assumption of such a protective or relaxation posture, possibly supplemented by a back rest and a bending joint in the Achilles tendon region and in the nape region. The desired continuous or finely graduated adjustability of the body support length between the retaining device and the head rest is achieved in a simple manner by the corresponding adjustability of the bent-knee support, provided that the distance between the retaining device and the head rest does not change at the same time on increasing of the bent-knee angle, which is the case in what are called heart parts of hospital beds. In these sick beds the bent-knee support consists of a thigh support and a calf support; the thigh support is articulated to the bed frame with its seat end and articulated to the calf support at its knee end. The foot end of the calf support is guided on the bed frame in the longitudinal direction thereof. In one form of embodiment of the invention the calf support with retaining device is articulated to the support table so that on a reduction of the calf support inclination (articulation point on the support table below the calf support plate) a reduction of the distance between retaining device and head rest even results. To take account of an increasing body elongation during a traction treatment it is consequently merely necessary correspondingly to reduce the bent-knee angle between calf and thigh by appropriate raising of the calf support. The especially simple assembly of the arrangement should be emphasised, since only one single, possibly rigid, part, namely the calf support, has to be fitted to the support table by means of a simple joint. The lack of supporting of the thighs in this case can be accepted by reason of the head-down position (any desired angle of inclination of the plane of the support table to the horizontal, for example between 20° and 90°, with additional strap securing, especially pelvis strap securing of the body), since a corresponding application pressure of the thigh decreases with the angle of inclination.

Since however with increasing angle of inclination the application pressure of the calf on the calf support increases, it is advantageous if the support length of the calf support is adaptable to the calf length of the person to be treated in each case.

In order that, independently of the bent-knee angle, the distance of the retaining device from the head rest may be modified to compensate for the body elongation, it is provided that the distance of the retaining device from the head rest is adjustable continuously or in fine graduations, possibly with unchanged setting of the bent-knee support. In addition or alternatively it can be provided that the point of articulation of the calf support to the support table can be shifted continuously or in fine stages in the longitudinal direction of the table.

In order that the support surface of the table may be adapted still better to the protective posture or relaxation posture desired in each case, especially for the setting of a specific pelvic angle, independently of the bent-knee angle, in a further development of the invention a back rest is provided.

With increasing inclination the application pressure of the back against the back rest also increases. It is therefore advantageous if the support length of the back rest is variable with simple means.

For exact adaptation of the support surface to the person to be treated in each case, according to a preferred form of embodiment the back rest as such is shiftable on the support table. To take account of the body elongation in traction treatment the back rest can be made shiftable even when the table is occupied and inclined.

The adaptation of the couch form to the body form in each case is still further improved by joints. Angling joints in the Achilles tendon region and in the nape region render possible the execution when necessary of corresponding angling movements of the person to be treated—these movements are often helpful specifically in the relaxation position (the unborn child carries out corresponding movements in the womb). The pivotability of the seat support plate renders possible the correction of specific posture injuries (for example scoliosis). The possibility of bending away the seat support plate permits an extensive adaptation to the body form in each case.

In order that the support table may be lowered into a lower level for entry, it is proposed that the horizontal axis of inclination of the support table be made vertically displaceable.

The adjustment functions can be obtained with technically simple, robust, reliably acting means, even when the table is occupied and inclined, if according to a further development of the invention servo-drive systems, preferably hydraulic servo-drive systems or stepping motor servo-drive systems, are used for the execution of at least some of the setting functions of the couch.

In an especially preferred form of embodiment of the invention at least one sensor is provided for the measurement of the tension or compression stresses exerted by the body upon the support table essentially in the longitudinal direction of the body. The values measured by these sensors are a reference for the actual body tension or compression loadings in the region of the sensor concerned. Thus with a compression stress sensor in the region of the head rest the tension or compression loading in the critical head-nape region can be monitored. A corresponding tension sensor in the region of the foot or calf retaining device permits monitoring of the tension loadings in the region of the lower extremities of the body. By comparision of the tension in the foot region with the compression stress in the head region it is furthermore possible to estimate the general tension stressing of the body. The higher is the tension stress in the foot region and the lower is the compression stress in the head region, the greater is the tension stressing of the body.

The sensors can be connected to an optical and/or acoustic display which permits a manual setting of the couch by appropriate manual controlling of the servo-drive systems. However a preferably programme-controlled control and regulator circuit arrangement coupled with the sensors can also be provided with the aid of which a predetermined condition of body tension can be set and also maintained during a traction treatment. The control and regulator circuit arrangement can be formed for the input of a treatment programme so that appropriate treatment programmes can be carried out automatically. In this way the tension or compression stressing of the body, especially in the delicate head - nape region, can be set independently of the body elongation to a constant value, or varied in a predetermined manner according to the progress of treatment. The tension stress measured by the sensor in the foot region directly permits conclusions as to the tension loading of the ankle joint and indirectly permits conclusions as to the adjoining joints (knee joint and pelvic region). Applications are also conceivable in which the couch is inclined in the opposite direction, that is with head above feet, in which case then compression stresses can also occur in the foot region, which can likewise be used for regulation. The head-down position is however preferred in most cases since the tension stressing then occurring decreases towards the head as a result of the force of gravity and thus is complementary to the loading of the upright body. In the case of excessive tension stressing in the foot region counter-controlling is effected, that is the table is shifted in the direction of a reduction of the tension stress, which can be achieved by corresponding slight pivoting back in the direction towards the horizontal and/or by adjustment of inclination and/or displacement of the back and foot rests.

The support table is provided with a heating attachment which permits warming of the body and thus acts against the danger of injuries. The preferably heatable cushion permits body support without local load peaks, which is of importance especially in the treatment of injured persons.

The invention will be explained below by preferred examples of embodiment with reference to the drawing, wherein:

FIG. 6 shows a lateral elevation of a further form of embodiment of the couch of adjustable inclination in accordance with the invention;

FIG. 7 shows a partial section of the arrangement in FIG. 6 along the line VII—VII and FIG. 8 shows a detail view of a carriage with an anglable seat support plate.

Figure 1:
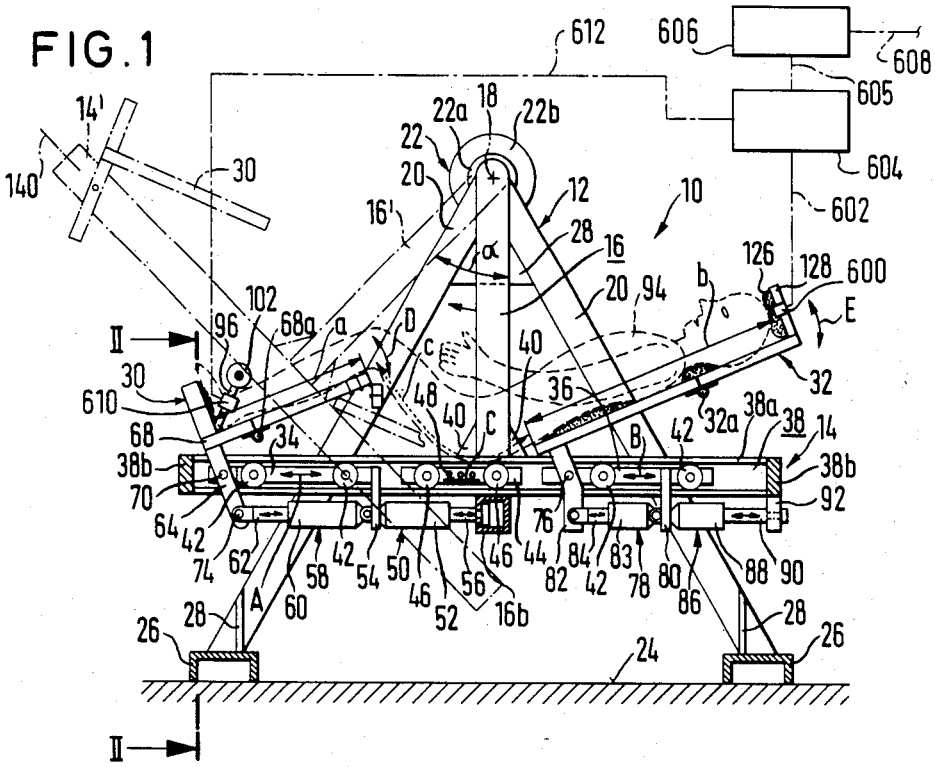
FIG. 1 shows a partially sectional lateral elevation of a couch of adjustable inclination for body extension (section line I—I in FIG. 2)
Figure 2:
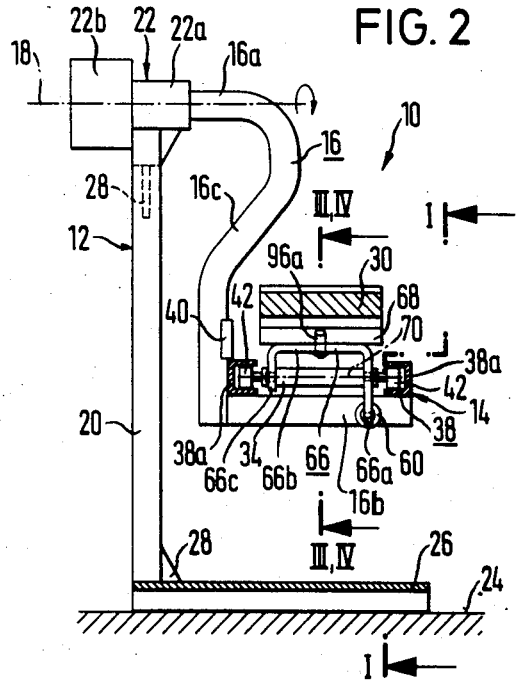
FIG. 2 shows a partially sectional view of the couch according to FIG. 1 from the foot end (section line II—II in FIG. 1)

The couch of adjustable inclination is designated in general by 10 in FIGS. 1 and 2. It consists of a couch carrier 12 and a support table 14 which is fitted, by means of a curved member 16 bent into approximately Z-form, on the couch carrier 12 for pivoting about a horizontal axis 18. The couch carrier consists of two oblique columns 20 which lie in a plane perpendicular to the axis 18 and diverge from one another, starting from a common carrier head 22, in the direction towards the floor 24. The oblique columns 20 are each welded with the lower end to a U-profiled foot 26 resting on the floor 24 and extending parallel to the axis 18. Stiffening plates 28 between the feet 26 and oblique columns 20 and in the region of the head 22 in the angle formed between the oblique columns 20 ensure the requisite mechanical stability. The couch carrier 12 can also have a different form, provided only that sufficiently great standing security is guaranteed even when the support table 14 is inclined.

The upper horizontal arm **16*a* in FIGS. 1 and 2 of the curved member 16 serves as rotation shaft, for which purpose it is rotatably mounted in a corresponding pivot bearing sleeve 22*a* of the carrier head 22. A hydraulic rotating motor 22*b* permits a pivoting movement of the curved member 16 and making fast of the curved member 16 in the pivotal position set in each case. In FIGS. 1 and 2 there is represented in a continuous outline the lowest position of the curved member 16 in which the member 16 lies in a vertical plane. In this position the support table 14 is situated in a horizontal plane. In FIG. 1 a pivotal position 16' of the member 16 is indicated in dot-and-dash outline which corresponds to a pivot angle $\alpha$ of about 45° in relation to the vertical plane. Accordingly the support table 14** is inclined by 45° in relation to the horizontal plane. In this case the foot end of the table is raised in comparison with the head end.

Figure 3:
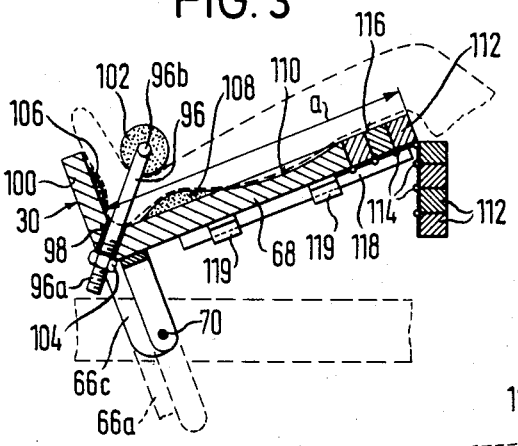
FIG. 3 shows an enlarged lateral view in section of the calf support of the couch according to FIGS. 1 and 2.
Figure 4:
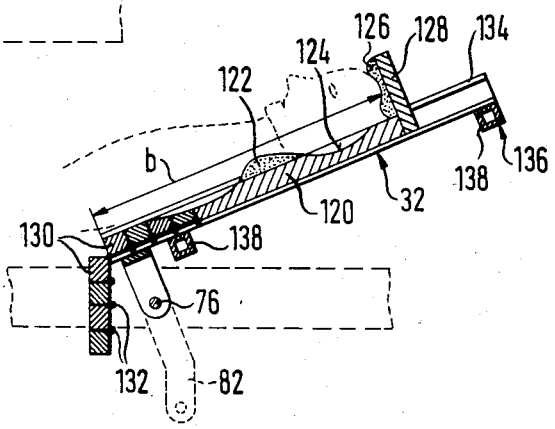
FIG. 4 shows an enlarged lateral view in section of the back rest of the couch according to FIGS. 1 and 2.

A calf support 30 to be explained by reference to FIG. 3 and also a back rest 32 represented separately in FIG. 4 are movably fitted on the support table 14 namely in such manner that both rests can be pivoted in relation to the table 14 about a joint axis parallel to the axis 18 and in addition can be displaced in the plane of the table by appropriate shifting of the respective joint in relation to the table 14. For this purpose the two rests 30 and 32 are articulatedly connected with a slide carriage 34 and 36 respectively which are again displaceable to and fro in the longitudinal direction of the table within a frame 38 of the table 14. The frame 38 is formed by two C-section longitudinal beams **38*a* with C-section openings facing one another and two transverse beams 38*b* at the two ends of the table. The two longitudinal beams 38*a* lie in the middle of the length on the lower horizontal arm 16*b* of the curved member 16, with which they are welded. Approximately triangular stiffening plates 40 in the angle region between the longitudinal beam 38*a* nearer to the oblique columns 20 and the vertically upwardly departing middle arm 16*c* of the curved member 16** ensure the necessary rigidity.

The two slide carriages 34 and 36 engage each with two mutually spaced guide rollers 42 in the C-section opening of the one and the other frame longitudinal beam **38*a*. This guarantees the desired displaceability in the direction of the length of the table 14 (double arrows A and B in FIG. 1**.

Between the two slide carriages 34 and 36 there is a further slide carriage 44 with corresponding guide rollers 46 which serves as support surface for the seat region. The mobility of the carriage 44 (in the longitudinal direction of the table 14) is indicated by a double arrow C in FIG. 1. For securing the carriage 44 in a selected position there serves for example a pin fastening with the aid of a pin (not shown) parallel to the axis 18 which has to be fitted from the side into one of the two longitudinal beams **38*a* to engage in one of several pin holes 48, indicated in FIG. 1, of the carriage 44**.

In order that the carriage 34 carrying the calf support 30 may be shifted continuously and under load, a hydraulic servo-drive system 50 is provided the cylinder 52 of which is secured rigidly to the carriage 34 through a flange 54 protruding downwards from the carriage 34 and the piston rod 56 of which engages with the table 14, in the example as illustrated with the horizontal arm **16*b* of the curved member 16. By appropriate charging of the cylinder 52 with pressure medium the carriage 34** can be displaced in the desired manner. By blocking of the flow of pressure medium a blocking of the carriage position set in each case is achieved.

A further hydraulic servo-drive system 58 serves for the pivoting of the calf support 30. The cylinder 60 is articulated to the flange 54 oppositely to the cylinder 50. The piston rod 62 acts on a link 64 rigidly connected with the calf support 30. The link 64 is formed according to FIG. 2 by a prolonged side leg **66*a* of a U-shaped support carrier 66. The middle leg 66*b* of the U-form is rigidly secured to the under side of a calf support board 68. The two side legs 66*a* and 66*c* are articulated to the slide carriage 34, forming a pivot axis 70 parallel to the axis 18. The point of articulation of the longer side leg 66*a* lies approximately in the middle between the board 68 and the piston rod joint 74. By appropriate actuation of the hydraulic servo-drive system 58 accordingly the calf support can be pivoted in the direction of the double arrow D in FIG. 1**.

In the same way the back rest 32 is pivotable to and fro in the direction of the illustrated double arrow E with the aid of a hydraulic servo-drive 78 on the slide carriage 36 about a pivot axis 76 parallel to the axis 18. The hydraulic servo-drive system again consists of a cylinder 83 articulated to a vertically downwardly protruding flange 80 of the carriage 36 and a piston rod 84 acting on a link 82 of the back rest 32.

Finally for the displacement of the slide carriage 36 of the back rest 32 in the direction of the double arrow B there serves a further hydraulic servo-drive system 86, the cylinder 88 of which is attached rigidly to the flange 80 and the piston rod 90 of which acts on a flange 92 of the frame 38 which protrudes downwards at the head end of the table.

In order to prevent a person lying on the support table 14, indicated in chain lines in FIG. 1, from sliding down from the support table 14 with inclination of the table increasing, on the calf support there is provided a foot-retaining device in the form of a T-shaped bar 96 of which the leg **96*a*, corresponding to the foot of the T-shape, is pushed through a passage opening 98 of the calf support 30 with its free end. The passage opening 98 is situated in a corner formed by the board 68 and a foot sole support board 100, namely between the two supported feet. The two arms 96*b* issuing from the leg 96*a* and forming the cross-bar of the T-form are provided with a cushioning 102 which is applied to the feet in the instep region. A nut 104 is screwed on to the end of the leg 96*a* pushed through the opening 98, for the fixing of the bar 96**. Other styles of fixing of the feet are conceivable also, for example securing loops or the like.

The board 100 and the board 68 are provided with cushionings 106,108 and if desired recesses 110 for anatomical adaptation of the support surface to the body lying thereon.

For the adaptation of the support length of the calf support 30 to persons with calves of different lengths the support length a of the calf support 30 is variable, namely in that at the knee support end the board 68 is divided into individual plate elements 112 in the form of narrow strips parallel to the axis 18, neighbouring strips being connected by piano-lid-type hinges 114 on the side remote from the support surface 116. Now in accordance with the desired length a more or less many elements 112 (three elements in FIG. 3) are supported on the back, namely by two mutually parallel locking bars 118 extending in the longitudinal direction of the calf support 30. Each locking bar 118 is retained displaceably on the under side of the board 68 by means of two tabs 119.

In FIG. 4 the back rest 32 is represented in more detail, namely in section along the line IV—IV in FIG. 2 (coinciding with the section line III—III in FIG. 2 for the sectional representation in FIG. 3). The back rest 32 consists of a board 120 which is provided with cushioning 122 and shaping 124 for adaptation to the body form. A head board 128 provided with a cushion 126 is fitted on the end of the board 32 more remote from the axis 76, protruding at right angles from the board 32. The support length b of the back rest 32 again can be varied similarly to the calf support 30 according to FIG. 3. Here again bar-type support elements 130 are provided, this time at the support end nearer to the pivot axis 76, and again are connected with one another on the inside with piano-lid-type hinges 132. The board 120 and the elements 130 are guided laterally in two longitudinal beams 134 of C-section form of a back rest frame 136. The two longitudinal beams 134 are rigidly connected with one another by transverse beams 138 indicated in FIG. 4. For the variation of the support length b, for example for shortening, the plate 120 is pushed downwards until one or more elements 130 come out of engagement with the C-section opening of the two longitudinal beams 134 and thereupon hinge downwards. When the desired support length b is reached, the plate 120 is fixed to the frame 136 in a manner not illustrated, for example by pin engagement.

For the execution of a traction treatment the corresponding person 94 places himself upon the support table 14, which has already previously been set roughly to the body dimensions by appropriate actuation of the hydraulic servo-drive systems 58, 50, 78 and 86. In the case of persons with rheumatic symptoms, muscle strain or the like a greater angling of the body will be preferable, that is a greater inclination setting of the calf support 30 and of the back rest 32 with correspondingly reduced distance of the two slide carriages 34 and 36 from one another. The carriage 44 lying therebetween, which can be equipped with a seat hollow, is brought into an appropriate intermediate position. The feet are fixed to the calf support 30 with the aid of the bar 96. The support lengths a and b are adapted if necessary to the body dimensions of the person lying on the table 14. The support length of the table 14, as the sum of the two support lengths a and b plus a support length c indicated in dotted lines in FIG. 1 (length of the arc, indicated in dotted lines in FIG. 1, following the under side of the body, between the knee end of the calf support 30 and the seat end of the back rest 32), now corresponds exactly to the support length of the body of the person 94 on the table 14. Thus the person 94 is in contact by the foot soles with the foot plate 100 and with the head with the head board 128. Now the support table 14 is pivoted by appropriate actuation of the hydraulic rotating motor 22b in the clockwise direction in FIG. 1, that is with the feet in advance, for example through an angle $\alpha$ of 45°.

The gravity force acting upon all parts of the body pulls these parts, by reason of appropriate force analysis, obliquely downwards in the direction of the now inclined table plate 140.

Since the person's head is supported by the head board 128, for the moment the body cannot elongate. In order to achieve this in regulated manner, the body support length, or more precisely the proportion c of the support length, is varied slightly, in that the angle of inclination of the calf support 30 in relation to the table plane 40 is enlarged and/or the carriage 34 carrying the calf support 30 is driven slightly towards the nearer table end. Especially in the case of strains in the nape region the support length will be fixed in such a way that no tension or compression stresses occur in the vertebrae situated in the nape region. In the course of the traction treatment however it is possible to permit more or less great tension stresses to act upon the neck and nape vertebrae by appropriate increase of the body support length. The increase of the body size of the treated person occurring during a traction treatment (up to about 2 cm.) is compensated by appropriate increase of the body support length (a+b+c). The relatively great bending of the person, corresponding to the protective posture, can be diminished in the course of the traction treatments so that at the end of the treatment in some cases one is working with extended body. The inclination angle $\alpha$ can amount to 180° or even more, in which case the pelvis is made fast to the table 14 if necessary by means of appropriate straps. Especially in the therapy of vertebral column torsions it is conceivable to pivot the support table in the opposite direction (that is in the anti-clockwise direction in FIG. 1), for example into the sitting position. Moreover the couch can also be used for orthopaedic gymnastics or as operating table.

Figure 5:
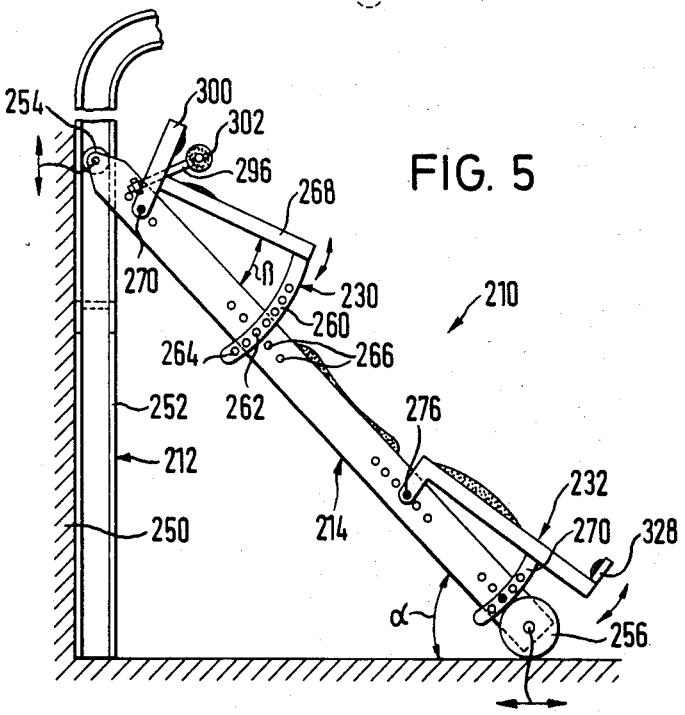
FIG. 5 shows a simplified lateral view of a further form of embodiment in accordance with the invention of the couch of adjustable inclination for body extension.

The form of embodiment of the invention as represented in FIG. 5 is distinguished by special simplicity. Components of this couch designated by 210 which correspond to components of the couch 10 according to FIGS. 1 to 4 are provided with the same reference numerals in each case increased by the number 200.

The carrier 212 for the support table 214 now consists of two vertically extending U-section rails 252 fitted on a vertical wall 250. The U-section openings of the mutually spaced rails 252 face one another and each receives a lateral guide roller 254 at one end of the length of the support table 214. At the other end of the support table there are two floor rollers 256. Thus if one lifts the left longitudinal end of the table 214 in FIG. 5, for example by appropriate actuation of a pulley tackle (not shown) secured to the room ceiling and acting on this table end, then the left table end moves upwards in the vertical direction, guided by the guide rollers 254 running in the rails 252. Accordingly any desired angles $\alpha$ of inclination of the table 214 in relation to the horizontal between 0° and 180° can be set.

The table 214 is provided with a calf support 230 and a back rest 232. The calf support 230 again consists of a calf support board 268 and a foot sole board 300. A bar 296 with foam cushioning 302 serves for the fixing of the feet to the calf support 230. The calf support 230 is articulated to the table 214 (joint axis 270). The angle of inclination desired in each case can be effected with the aid of an arcuate bar 260 at the knee end of the calf support 230 which can be made fast on the table 214 either by means of a pin connection (pin 262; pin apertures 264 in the bar 260) or otherwise (snap-in connection; frictionally engaging connection). The possibility also exists, for adaptation to different body sizes, of shifting the articulation point (axis 270) and correspondingly also the pin connection (pin apertures 266 in the table 214) in the longitudinal direction of the table.

In the same manner the back rest 232 is also articulated to the table 214 (pivot axis 276) using an arcuate bar 270 for fixing the pivot angle in each case. Here again the possibility exists of shifting the articulation point.

In conformity with the couch 10 according to FIGS. 1–4, in the case of the couch 210, with the table 214 in the horizontal position it is adapted to the body size of the person to be treated in each case, so that the foot sole board 300 and the head board 328 abut each on the appropriate part of the body. The feet are fixed with the aid of the bar 296 to the calf support 230. Now by the operation of the pulley block or another drive, as for example a vertical spindle drive, the wall end of the table is raised until the desired angle $\alpha$ of inclination is reached. To take account of the body elongation now a second person slightly increases the angle $\beta$ of inclination of the calf support 230 in relation to the plane of the table. In the first traction treatment, especially in severely strained patients, a relatively large initial value is selected for the angle $\beta$. This angle is reduced step by step in subsequent traction treatments.

The adjustment of inclination of the calf support 30; 230 and of the back rests 32; 232 and possibly also the displacement of the joint axis in each case 70; 270; 76; 276 in the longitudinal direction of the table can take place continuously (couch 210) or in fine steps (couch 10) in order to be able most extensively possible to follow the body elongation in the traction treatment. The size of an adjustment step preferably corresponds to a variation of the body support length, that is the size c, of less than 1 cm., better less than 0.5 cm., optimally about 1 mm. or less.

Regarding the form of embodiment according to FIGS. 1 and 2 it should be added that in those cases where a relatively great access height of the couch can be accepted it is naturally also possible in place of the curved member 16 bent into Z-shape to use a straight, horizontally extending bar.

Regarding FIG. 1 it should further be added that for further improvement of the adaptability of the table 14 to the body form in each case an angling joint 68*a* of the lower leg support board 68 can be provided, as also an angling joint 32*a* of the back rest 32, each with angling axis parallel to the axis 18. The former joint 68*a* is situated in the Achilles tendon region and the other joint 32*a* in the nape region. Both angling joints are formed, in a manner not illustrated, for optional adjustment and arresting of the angle in each case, for which again hydraulic servo-drive systems can be used if appropriate. In the region of the head cushion 126 a pressure sensor 600 can be fitted which measures the pressing force on the head of the person to be treated in each case, especially the longitudinal component approximately parallel to the vertebral column. This longitudinal component is a direct measure for the tension or compression stressing of the body in the head-nape region. Thus the pressure sensor 600 indicates whether the neck and nape vertebrae are subject to a tension or compression stress, stating the stress magnitude. The pressure sensor is connected through a lead 602 with a corresponding optical or acoustic display 604, so that the couch can be adjusted by an appropriate operator in the desired manner, for example so that neither compression nor tension stress is exerted upon the vertebrae of the neck and nape. The pressure sensor is coupled through the display 604 and a lead 605 with a control and regulator circuit arrangement 606 which serves for the setting and possibly maintenance of a pre-determined state of body stress by appropriate actuation of the servo-drive systems. For this purpose the control and regulator circuit arrangement 606 is connected with the hydraulic servo-drive systems through a control lead 608, shown broken away. The control and regulator circuit arrangement 606 may be made programmable in order to be able to carry out standard programmes or individual programmes automatically for the person to be treated. In such a programme, possibly time-dependent ideal stresses are pre-stated and by appropriate actuation of the servo-drive systems the body stress values ascertained by the sensor 600 are approximated to the ideal stresses. For the measurement of the stress condition of the body and corresponding regulation of the servo-drive systems still further tension or compression stress sensors, in addition to the pressure sensor 600 in the head region, can be provided on the couch, especially a tension stress sensor 610 in the foot region (for example on the bar 96 of the foot-retaining device). This is connected through a lead 612 with the display 604 and through the lead 604 with the control and regulator circuit arrangement 606. The sensor 610 permits the monitoring of the body tension stresses in the region of the lower extremities. By comparison of the compression stress in the head region with the tension stress in the foot region one furthermore obtains a reference for the general tension stressing of the body which is usable for the regulation of the servo-drive systems.

In order to promote muscle relaxation the support table can be provided with a heating attachment not shown). In order to permit the occurrence of no compression stressing, as far as possible, especially in the case of injured persons, a heatable cushion can be laid upon the support table, as underlayer for the person to be treated.

At the beginning of therapy the patient is laid upon the table, which is pivoted into the horizontal position, and the table is adjusted so that the compression force in the longitudinal direction of the body, exerted by the head upon the head cushion 26 and measured by the sensor 600, disappears. The tension stress in the foot region should likewise be just zero, or assume a predetermined initial value, apart from the compression of the foam material pad 102. If now the table is inclined an increase of the pressure in the head region and of the tension in the foot region occurs in dependence upon the adjustment of the couch in each case, especially in dependence upon the angles of the back and calf supports and in dependence upon the connective tissue properties, especially the connective tissue elasticity, of the individual body segments of the patient. The measured tension stress in the foot region permits direct conclusions as to the tension loading of the ankle and indirectly of the adjoining joints, (knee joint and pelvic region). Now the patient can be subjected to a traction treatment in which the body stress conditions measured indirectly through the sensors are monitored and used for the regulation of the setting of the couch. Thus the couch as described permits traction treatments which take consideration of the individually different body stretching properties. The duration of therapy can be reduced to the minimum value in each case without danger of excessive tension or compression stressing of the body.

In FIGS. 6 and 7 there is represented a further form of embodiment of the couch, designated generally by 310. Components which correspond to components of the couch 10 according to FIGS. 1–4 are here provided with the same reference numerals in each case increased by the number 300.

The form of embodiment 310 is distinguished in that the horizontal axis 318 of inclination is made not fast in location as in FIG. 1 but vertically displaceable. For this purpose a vertical rail 452 with C-section, fitted for example on a vertical wall 450, is provided which receives a slide piece 454. The outline of the slide piece 454 is indicated in chain lines in FIG. 6. A vertical displacement drive (not shown), which can be formed by a cable winch, a rack drive with vertical rack or a hydraulic telescopic cylinder, acts on the slide piece 454. The slide piece 454 is formed with an extension protruding from the section interior with flange plate 456 on which a hydraulic rotating motor **422*b* is flanged (corresponding to the motor 22*b* in FIGS. 1 and 2). A square tube 416 corresponding to the curved member 16 and carrying the support table 314 is welded to the rotating shaft 458 of the motor. The rail 452 is screwed by means of lateral fastening tabs 460 at both rail ends to the vertical wall 450 (screws 462**).

The person to be treated can comfortably climb on to the low-set support table 314 (solid line in FIG. 6). Then the table 314 is driven vertically upwards along the rail 452 (direction arrow A) into the position indicated in chain lines in FIG. 6. In this position the table 314 can be pivoted through any desired angle about the axis 318.

In FIG. 8 there is represented diagrammatically a seat support plate 502 of adjustable inclination, as part of the modified slide carriage 544 corresponding to the carriage 44 in FIG. 4. Appropriate rollers 546 at both ends of the carriage are indicated in FIG. 8. The adjustment of inclination of the seat support plate 502 can take place for example again by means of a hydraulic servo-drive system 504, with a hydraulic cylinder 506 which is pivotably secured on a tab 508 fast with the carriage and with a piston rod 510 the free end of which articulatedly engages with a link 512. The link 512 issues vertically downwards from the plate 502 and is mounted pivotably about a horizontal axis on a pivot bolt 514 on the carriage 544, in the region of the middle of its length. An additional plate 516 can be secured for adjustment in inclination on the plate 502, with a horizontal pivot axis 518 indicated in FIG. 8. The axes 518 and 514 are parallel to the axis 18 according to FIGS. 1 and 2. The pivot angle $\gamma$ between the plate 502 and the additional plate 516 can be varied according to the body form in each case by hand or by motor by means of a hydraulic servo-drive system (not shown).

What is claimed is:

1. Couch of adjustable inclination, especially for body extension of a person lying on the couch in a head-down position, comprising a couch carrier means, a support table securable on the carrier means in different inclinations, a foot retaining device mounted at one end of the table and a head rest mounted at the other end of the table, a back rest articulated to the table and supporting said head rest, a calf support mounted on the support table for supporting the legs with knees bent, the calf support adjustable continuously or in fine stages for the variation of the bending angle of the knee defined between lower leg and thigh, wherein a total body support length is defined by the length of the calf support, the length of the back rest and the distance between adjacent ends of the calf support and the back rest, the body support length being adjustable continuously or in fine stages in accordance with the increasing body extension with the table occupied and inclined in a head-down position, and wherein the foot retaining device is mounted on the support table so that the distance between the foot retaining device and the head rest does not decrease when the calf support is adjusted for changing the bending angle of the knee.

2. Couch according to claim 1, wherein the calf support is formed by a lower leg support articulated to the support table.

3. Couch according to claim 2, wherein the foot retaining device is attached to the lower leg support.

4. Couch according to claim 2, comprising at least one support element removably attached to the knee end of the lower leg support, so that the support length of the lower leg support is variable.

5. Couch according to claim 2, wherein the point of articulation of the lower leg support on the support table is displaceable continuously or in fine stages in the longitudinal direction of the support table.

6. Couch according to claim 1, wherein the head rest includes a scalp support surface.

7. Couch according to claim 1, wherein the distance of the foot retaining device from the head rest is adjustable continuously or in fine stages with unchanged adjustment of the bending angle of the calf support.

8. Couch according to claim 1, wherein the back rest is articulated with adjustable inclination to the support table.

9. Couch according to claim 8, comprising a back rest frame for the back rest and a back plate carrying the head rest mounted displaceably in the longitudinal direction within the back rest frame, so that the support length of the back rest is variable.

10. Couch according to claim 8, wherein the point of articulation of the back rest to the support table is displaceable continuously or in fine stages in relation to the support table in the longitudinal direction of the table.

11. Couch according to claim 1, comprising an angling joint of the lower leg support in the Anchilles tendon region.

12. Couch according to claim 1, comprising an angling joint of the back rest in the nape region.

13. Couch according to claim 1, comprising a seat support plate of adjustable inclination slideably attached to the support table.

14. Couch according to claim 13, wherein the seat support plate is made of two support plate members and the angle defined between the support plate members is adjustable.

15. Couch according to claim 1, wherein the couch carrier means includes a vertical guide rail and the support table includes a horizontal inclination shaft, a slide piece connected to the inclination shaft vertically displaceably mounted in the vertical guide rail, so that the support table is vertically displaceable, and comprising a vertical displacement drive acting upon the slide piece.

16. Couch according to claim 1, comprising servo-drive systems for executing at least some of the adjustment functions of the couch.

17. Couch according to claim 16, comprising at least one sensor for the measurement of tension or compression stresses exerted by the body upon the support table essentially in the longitudinal direction of the body.

18. Couch according to claim 17, wherein the sensor is mounted in the region of the head rest.

19. Couch according to claim 17, wherein the sensor is mounted in the region of the foot retaining device.

20. Couch according to claim 17, comprising an optical display connected to the at least one sensor.

21. Couch according to claim 20, wherein the servo-drive systems are controlled based upon the difference of the tension stress measured by one sensor mounted in the region of the foot retaining device and the compression stress measured by another sensor mounted in the region of the head rest.

22. Couch according to claim 17, comprising an acoustic display connected to the at least one sensor.

23. Couch according to claim 17, comprising a control and regulator circuit arrangement for actuating the servo-drives and coupled to the at least one sensor for setting a predetermined state of body stress in accordance with a predetermined treatment program.

24. Couch according to claim 23, wherein the control and regulator circuit arrangement is program-controlled.

25. Couch of adjustable inclination for tension or compression stressing of portions of the body of a person lying on the couch in a head-down position, comprising a couch carrier means, a support table securable on the carrier means in different inclinations, a foot retaining device mounted at one end of the table and a head rest mounted at the other end of the table, wherein the body support length provided by the couch between the retaining device and the head rest is adjustable continuously or in fine stages, at least one sensor for measuring the tension force exerted by the body on the foot retaining device, at least one sensor for measuring the compression force exerted by the scalp on the head rest, manually actuated servo-drive systems for adjusting the body support length, and an acoustic and/or optical display connected to each of the sensors.

26. Couch of adjustable inclination for tension or compression stressing of portions of the body of a person lying on the couch in a head-down position, comprising a couch carrier means, a support table securable on the carrier means in different inclinations, a foot retaining device mounted at one end of the table and a head rest mounted at the other end of the table, wherein the body support length provided by the couch between the retaining device and the head rest is adjustable continuously or in fine stages, at least one sensor for measuring the tension force exerted by the body on the foot retaining device, at least one sensor for measuring the compression force exerted by the scalp on the head rest, a control and regulator circuit arrangement connected to the sensors, and servo-drive systems for adjusting the body support length, the servo-drive systems connected to the control and regulator circuit arrangement for the automatic control of the servo-drive systems in dependence upon the difference between the measured tension and compression forces.

27. Couch according to claim 26, comprising a back rest articulated to the support table and a head contact member connected to and extending at a right angle from the back rest.

* * * * *